US006702558B2

(12) United States Patent
Becher

(10) Patent No.: US 6,702,558 B2
(45) Date of Patent: Mar. 9, 2004

(54) TWIN SCREW ROTORS AND DISPLACEMENT MACHINES CONTAINING THE SAME

(75) Inventor: Ulrich F. Becher, Porrentruy (CH)

(73) Assignee: Ateliers Busch SA, Chevenez (CH)

( * ) Notice: Subject to any disclaimer, the term of this patent is extended or adjusted under 35 U.S.C. 154(b) by 0 days.

(21) Appl. No.: 10/297,891

(22) PCT Filed: Jul. 6, 2001

(86) PCT No.: PCT/CH01/00421

§ 371 (c)(1),
(2), (4) Date: Dec. 11, 2002

(87) PCT Pub. No.: WO02/08609

PCT Pub. Date: Jan. 31, 2002

(65) Prior Publication Data

US 2003/0152475 A1 Aug. 14, 2003

(30) Foreign Application Priority Data

Jul. 25, 2000 (CH) ..... 1472/00

(51) Int. Cl.[7] ..... F01C 1/16

(52) U.S. Cl. ..... 418/201.1; 418/201.3; 418/9

(58) Field of Search ..... 418/201.1, 201.3, 418/9

(56) References Cited

U.S. PATENT DOCUMENTS 2,691,482 A * 10/1954 Ungar ..... 418/9
5,667,370 A * 9/1997 Im ..... 418/9
6,139,297 A 10/2000 Becher
6,158,996 A 12/2000 Becher
6,341,951 B1 * 1/2002 Chen et al. ..... 418/9
6,368,091 B1 * 4/2002 Mito ..... 418/201.3
6,447,276 B1 * 9/2002 Becher ..... 418/201.3

FOREIGN PATENT DOCUMENTS

| | | |
|---|---|---|
| AT | 261792 | 8/1967 |
| DE | 87685 | 7/1896 |
| DE | 594691 | 4/1934 |
| DE | 609405 | 2/1935 |
| DE | 24 34 782 | 2/1975 |
| DE | 24 34 784 | 2/1975 |

(List continued on next page.)

*Primary Examiner*—Thomas Denion
*Assistant Examiner*—Theresa Trieu
(74) *Attorney, Agent, or Firm*—Oliff & Berridge, PLC

(57) ABSTRACT

The twin screw rotors for axis-parallel installation in displacement machines for compressible media have asymmetrical transverse profiles and numbers of wraps that are ≧2. Depending upon the wrapping angle (α), the pitch (L) varies, which pitch increases in a first subdivision ($T_1$) from the suction-side screw end, reaches a maximal value ($L_{max}$) after one wrap, decreases in a second subdivision ($T_2$) until a minimal value ($L_{min}$), and is constant in a third subdivision ($T_3$). The pitch course in the first subdivision ($T_1$) is preferably mirror-symmetrical to that in the second subdivision ($T_2$), within the subdivisions $T_1$ to $T_2$, it is point-symmetrical to the mean values in almost all cases. Compact screw rotors, completely free of imbalance, can thereby be achieved with compression rates of 1.0 . . . 10.0, also without profile variation. Such rotors offer the best prerequisites for reduction in energy requirements, temperature, construction size, costs, as well as for free selection of working materials in applications in chemistry, pharmacy, packaging, and semiconductor technology.

14 Claims, 11 Drawing Sheets

FOREIGN PATENT DOCUMENTS

| | | | | | |
|---|---|---|---|---|---|
| DE | 29 34 065 | | | 4/1980 | |
| DE | 29 44 714 | A1 | | 5/1981 | |
| DE | 33 32 707 | A1 | | 3/1985 | |
| DE | 195 30 662 | A1 | | 2/1996 | |
| DE | 44 45 958 | A1 | | 6/1996 | |
| EP | 0 697 523 | A2 | | 2/1996 | |
| EP | 0 736 667 | A2 | | 10/1996 | |
| EP | 0 866 918 | B1 | | 9/1998 | |
| EP | 0 995 879 | A1 | | 4/2000 | |
| EP | 1 070 848 | A1 | | 1/2001 | |
| GB | 112104 | | | 12/1917 | |
| GB | 670395 | | | 4/1952 | |
| GB | 2 292 589 | A | | 2/1996 | |
| JP | 02305393 | A | * | 12/1990 | ..... F04C/18/16 |
| SE | 85331 | | | 1/1936 | |
| WO | WO 97/21925 | | | 6/1997 | |
| WO | WO 98/11351 | | | 3/1998 | |
| WO | WO 00/25004 | | | 5/2000 | |
| WO | WO 00/47897 | | | 8/2000 | |

* cited by examiner

±B L2/2π
L2/2π
±A L1/2π
L1/2π
W'
W' <α>
T1
T2=j.2π
T3
K.2π
-2π
-π
ø
2π
4π
6π
α

W'MAX=L0(1+A)/2π
L0/2π
W'MIN=L0(1-A)/2π
α
W'
W' <α>
T1
T2
T3=ø
K.2π
-2π
-π
ø
π
2π

TWIN SCREW ROTORS AND DISPLACEMENT MACHINES CONTAINING THE SAME

BACKGROUND

1. Field of Invention

The invention relates to twin screw rotors for axis-parallel installation in displacement machines for compressible media, with asymmetrical transverse profiles with eccentric center of gravity position as well as number of wraps ≧2 and with pitch varying depending upon the wrapping angle ($\alpha$), which pitch increases in a first subdivision from the suction side screw end, reaches a maximal value at $\alpha=0$ after one wrap, decreases in a second subdivision until a minimal value, and is constant in a third subdivision.

2. Description of Related Art

Known from the publications SE 85331, DE 2434782, DE 2434784 are internal-axis, screw-type machines with non-constant pitch of the screw members or varying transverse profiles. The partially single-threaded inner rotor is balanced with the aid of counterweights. The construction expense necessary therefor is high and the assembly time-consuming. A further, general drawback compared to external-axis machines is the suction-side sealing, which cannot be eliminated.

Furthermore, described in the patent documents DE 2934065, DE2944714, DE 3332707 and AT 261792 are double-shaft compressors with screw-like rotors where rotors and/or housing are made up of disc sections of differing thickness and/or contour disposed axially behind one another, and thus cause an inner compression. Since defective chambers and eddy zones arise owing to the stepped construction, reduced efficiency results compared with screw rotors. Furthermore, problems are to be expected relating to shape retention during heating up in operation.

Screw-type compressors with outer engagement of the screw rotors, rotating in opposite directions, are represented by several publications:

DE 594691 describes a screw-type compressor with two outer meshing rotors running in opposite directions with variable pitch and thread depth as well as diameter variation. The profile is shown as single-threaded with trapezoid shape in the axial section. Indications about balancing are lacking, however.

DE 609405 describes pairs of screw members with variable pitch and thread depth for operation of compressors and decompressors in air cooling machines. A special transverse profile is not indicated, the optical impression suggesting a single-threaded trapezoidal axial section. There is no indication of balancing although operation is supposed to be at high rotational speeds.

DE 87 685 describes screw rotors with increasing pitch. They are intended for installation in machines for expanding gases or vapors. They are designed as single-threaded or multi-threaded screw members, there being no indication of balancing.

DE 4 445 958 describes a screw-type compressor with outer meshing screw elements, rotating in opposition, "which become continuously smaller from the one axial end to the second axial end remote therefrom . . . " They are used in vacuum pumps, motors or gas turbines. The profile is shown as a rectangular profile; proposed alternatively is an embodiment with a trapezoidal thread. Here, too, there is no indication of balancing.

EP 0 697 523 describes a compressor type with screw rotors with multi-threaded, outer meshing profiles and continuous change of pitch. The point symmetrical profiles (S.R.M. profiles) directly bring about a static and dynamic balancing.

Shown in EP 1 070 848 are screw-shaped profile bodies with variable pitch in two-threaded design " . . . in order to be able to be better balanced." Lacking is the indication about a special profile geometry; the drawing shows a symmetrical rectangular profile in axial section.

In some of the previously known documents of the state of the art above, the outer diameters vary, which leads to problems in manufacture and assembly. Common to all the solutions proposed in the publications mentioned are the high leakage losses through use of unfavorable profiles: an axial sequence of well sealed working cells is not possible with such profiles; a good inner compression is not possible at low or medium rotational speeds (blow hole leads to vacuum losses and losses with respect to efficiency).

Profiles with good sealing off are disclosed in the printed publications GB 527339 (double-threaded, asymmetrical), GB 112104, GB 670395, EP 0 736 667, EP 0 866 918 (single-threaded).

According to the following two publications, single-threaded profiles with good sealing off are used. Their pitch varies, but the outer diameters are kept constant:

DE 19530662 discloses a screw-type suction pump with outer meshing screw elements, "whereby the pitch of the screw elements decreases continuously from their inlet end to their outlet end in order to bring about the compression of the gases to be delivered." The shape of the teeth of the screw rotor displays an epitrochoidal and/or Archimedian curve. The drawback of rotors of this kind is that the achievable inner compression is mediocre.

Proposed in WO 00/25004 are twin screw rotors, the pitch course of which is not monotone, but instead at first increasing, then afterwards decreasing, and finally remaining the same. The transverse profile is single-threaded and asymmetrical and displays a concave flank. The outer diameter is constant, a profile variation being possible.

In neither of the two aforementioned publications is the problem of balancing touched upon.

Disclosed in WO 00/47897 are multi-threaded twin delivery screw members with equal asymmetrical transverse profiles each with a cycloidal hollow flank, alternatively the pitch or the pitch and the transverse profile being able to be varied along the axis and " . . . correspondence of profile center of gravity and point of rotation being achieved through respective design of the individual transverse profile delimitation curves." (=balancing). Provided in the screw interior (in the regions of the teeth) are screw-shaped channels which are intended to be passed through by a cooling medium.

A manufacturing limitation is the relationship thread depth/thread height, limited to values $c/d<4$, which leads to restriction of the compression rates achievable or to enlargement of construction space. The problem intensifies with increasing thread number. Moreover the manufacturing expense grows with increasing thread number, so that in principle single-threaded rotors would be desirable as long as the problem of balancing can then be solved satisfactorily and as long as multi-threaded rotors are not altogether more advantageous or necessary for other reasons (for example rotor cooling).

Described in the documents JP 62291486, WO 97/21925 and WO 98/11351 are methods for balancing single-threaded rotors, the pitches being presupposed as constant. With modified measures, similar methods can be used for balancing rotors with variable pitch, however with very severe limitation of the permissible geometry since a balancing through hollow spaces creates additional problems in casting, which become even greater because of the asymmetrical mass distribution as a condition of the pitch variation.

SUMMARY OF THE INVENTION

It is therefore the object of the present invention to propose technical solutions for balancing screw rotors with variable pitch and eccentric position of the transverse profile center of gravity, whereby the following requirements have to be fulfilled:

| | |
|---|---|
| relationship thread depth/thread height c/d < 4 | (manufacture) |
| short construction length | (rigidity, construction size) |
| 7 > number of wraps ≧ 2 | (manufacture, end vacuum) |
| volumetric efficiency: as great as possible | (construction size) |
| compression rate can be selected as freely as possible between 1.0 . . . 10.0 | (temperature, energy) |
| transverse profile: loss-free | (energy) |
| outer diameter = constant | (manufacture, assembly) |
| material can be selected as freely as possible | (manufacture, application) |

The object stated above is attained in that static and dynamic balancing is achieved with the twin screw rotors through calculated balancing of overall wrapping angle, defined pitch course and ratio of maximal pitch to minimal pitch, or is achieved at least 80% and is supplemented by changes in the geometry in the region of the screw ends.

The useful shortening of the screw spiral flanks coming to a sharp edge takes place along with coordination with a wrapping angle enlargement on both sides ($\mu$) and with the pitch. Recesses in the region of the screw end faces are used as additional measures for the balancing, if extreme conditions require this.

Such rotors offer the best prerequisites for reduction of the energy requirement, the temperature, the construction size and the costs, as well as for a free selection of working materials in applications in chemistry and semiconductor technology. The following calculations give the theoretical bases, which show that a screw rotor according to the present invention fulfils the balancing requirement on the basis of its shape.

Special embodiments of the twin screw rotors according to the invention are described in the dependent claims.

BRIEF DESCRIPTION OF THE DRAWINGS

The invention will be explained in the following, by way of example, with reference to the drawings. Shown are.

DETAILED DESCRIPTION OF PREFERRED EMBODIMENTS

Figure 1:
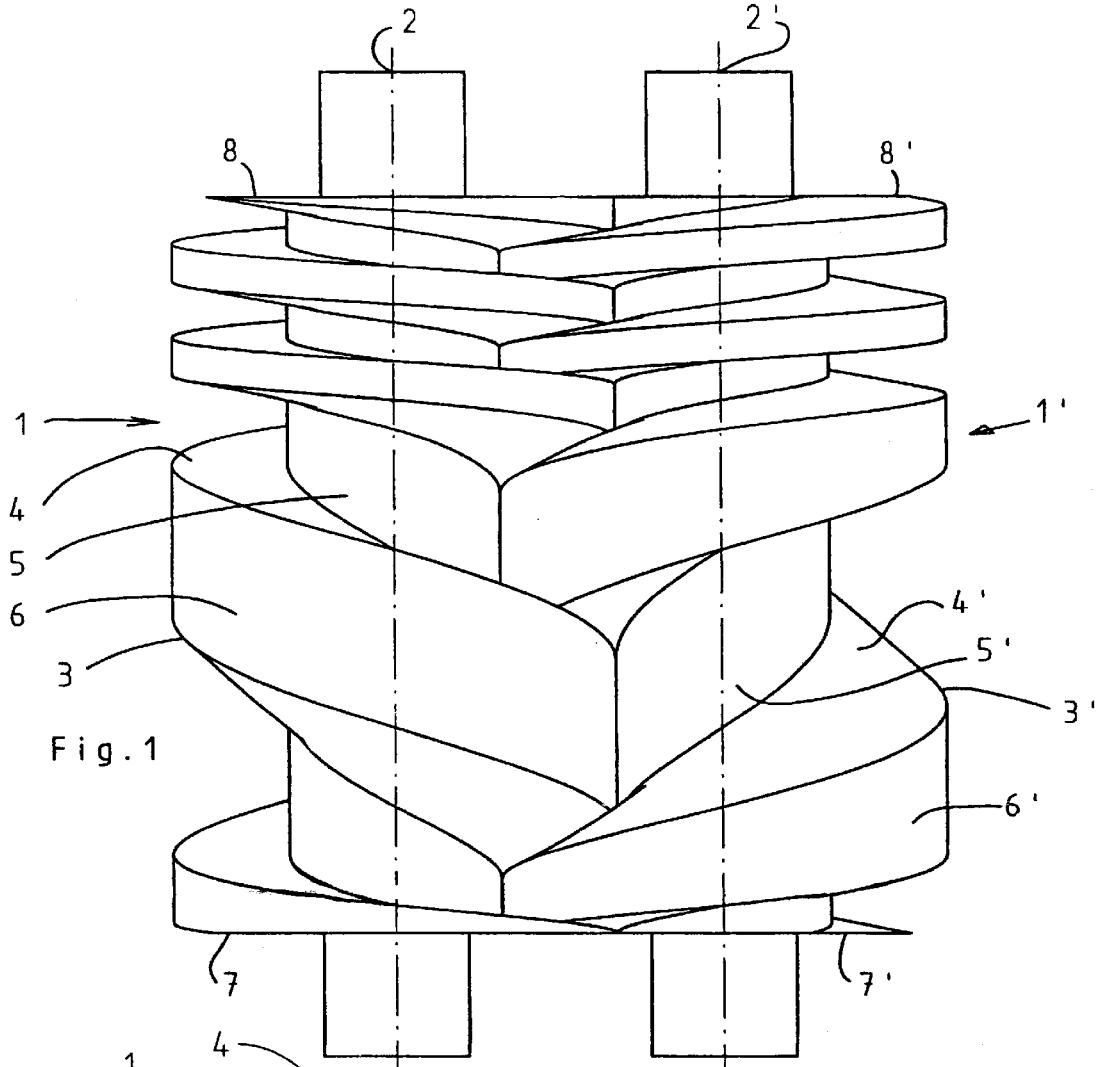
FIG. 1: a set of single-threaded twin screw rotors in a first embodiment example according to the invention in a view from the front.

First, the symbols needed for the calculation are indicated. The respective units are given in brackets. "Rad" refers to radians.

j=number of wraps of the region $T_2$ (decreasing pitch) [-]

K=number of wraps [-]

$\Delta\alpha$=total wrapping angle of the center-of-gravity helix=$K\cdot 2\pi$ [Rad]

$\alpha$=current wrapping angle of the center-of-gravity helix= parameter [Rad]

$\alpha_0$=current wrapping angle of the geometric reference helix (concave flank base) [Rad]

U, V, W=orthogonal system of coordinates [cm, cm, cm]

U-axis=reference direction

W-axis=rotational axis identical to geometric center line w=w<$\alpha$>=axial position [cm]

$w'\frac{\partial w}{\partial \alpha}$ = change in axial position [cm/Rad]

"pitch": general definition: axial progression during 1 revolution $L_0$ = mean pitch = constant $\Rightarrow w\langle\alpha\rangle = L_0 \cdot \alpha / 2\pi$ [cm]

or $L_0 = 2\pi \cdot \frac{w}{\alpha}$ dynamic pitch = $L_{dyn} = 2\pi \cdot \frac{\partial w}{\partial \alpha} = 2\pi w' \Rightarrow L_{dyn} \sim w'$ [cm]

$L_1$, $L_2$ average pitches of the regions $T_1$, $T_2$ [cm]

$g\langle w\rangle = f\langle w\rangle \cdot r\langle w\rangle$ [$cm^3$]

$f\langle w\rangle$=transverse sectional area of the rotor as function of w [$cm^2$]

$r\langle w\rangle$=center-of-gravity center distance as function of w [cm]

$\dot{\theta}\frac{\partial\theta}{\partial t} = \omega = 2\pi / T$ = rotor rotational speed [Rad/sec]

$\pi$=pi=3.1415 [-]

T=duration of a revolution [sec]

t=time [sec]

$\tau=\gamma/b$ [g $sec^2/cm^4$]

$\gamma$=specific weight [$g/cm^3$]

b=Earth acceleration=981 [$cm/sec^2$]

$P_u$, $P_v$=force components $M_{v,w}$, $M_{u,w}$=moment components $\mu$=wrapping angle enlargement [Rad]

$\eta$=relative position angle of the balancing volume [Rad]

$Q=g_Q \cdot r_Q$ moment of inertia [$cm^4$]

$g_Q$=balancing volume [$cm^3$]

$r_Q$=center of gravity center distance of the balancing volume [cm]

Calculations

Generally applicable:

$$\frac{P_u}{\tau\omega^2} = \sum\left(\int (g\langle w\rangle w'\langle\alpha\rangle \cos\alpha) d\alpha\right) \quad (1)$$

$$\frac{P_v}{\tau\omega^2} = \sum\left(\int (g\langle w\rangle w'\langle\alpha\rangle \sin\alpha) d\alpha\right) \quad (2)$$

$$\frac{M_{v,w}}{\tau\omega^2} = \sum\left(\int (g\langle w\rangle w\langle\alpha\rangle w'\langle\alpha\rangle \sin\alpha) d\alpha\right) \quad (3)$$

$$\frac{M_{u,w}}{\tau\omega^2} = \sum\left(\int (g\langle w\rangle w\langle\alpha\rangle w'\langle\alpha\rangle \cos\alpha) d\alpha\right) \quad (4)$$

Profile constant=>g<w>=const.=$g_0$

Number of wraps in whole numbers K=2, 3, 5, 6, 7 . . .

Figure 13:
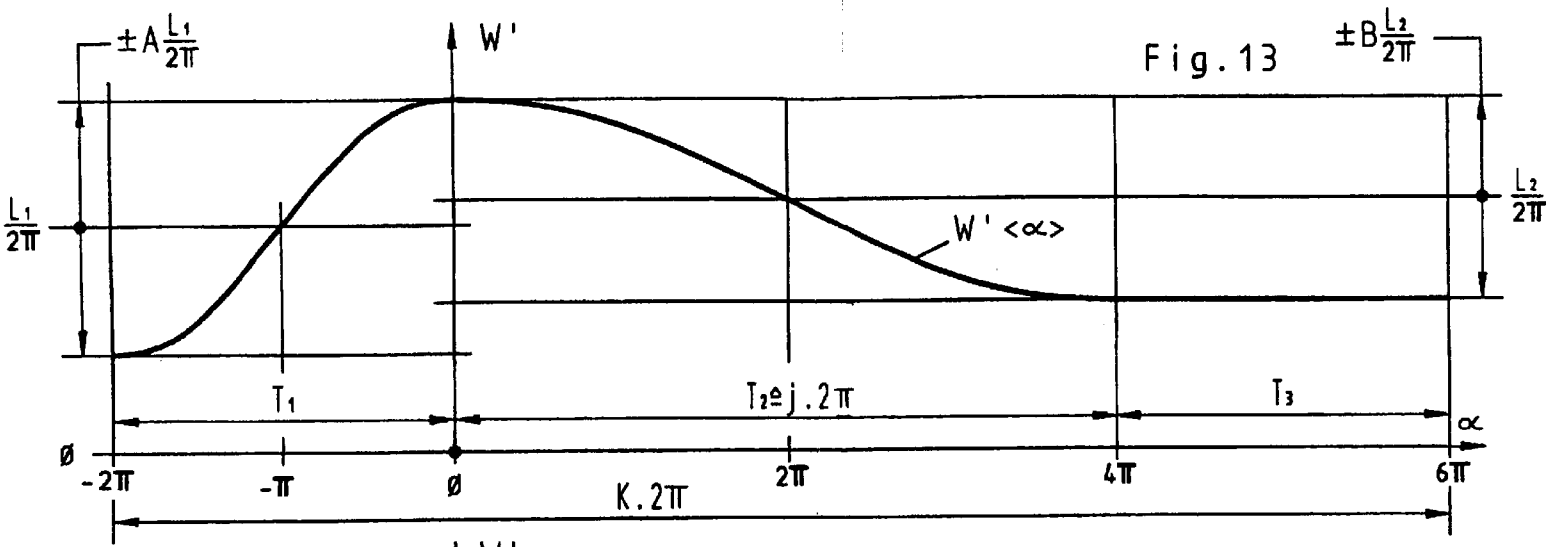
FIG. 13: the most general case of a pitch course according to the invention.

The most general case for a pitch course that brings about a balancing in the sense of the invention is shown in FIG. 13:

1. Pitch on the suction-side end is not equal to the pitch on the pressure-side end. ($L_1 \cdot (1-A) \neq L_2 \cdot (1-B)$).
2. The region $T_2$ of the decreasing pitch extends over j wraps. j=1, 2, 3, . . . .

Functions w'<α> can be found, which, in balancing with A, B, $L_1$ and $L_2$ from the equations (1), (2), (3), (4), result in the value "0" for all 4 partial components, which means that static and dynamic balancing is thereby achieved.

For the special application here, i.e. screw rotors for installation in displacement machines for compressible media, no advantages can be found, however, for j>1 and unequal pitches at the screw ends, so the following simplifications have been undertaken for the further calculations of the embodiment examples explained:

$T_2$=mirror-inverted to $T_1$; mirror axis≡α=0 =>

Figure 5:
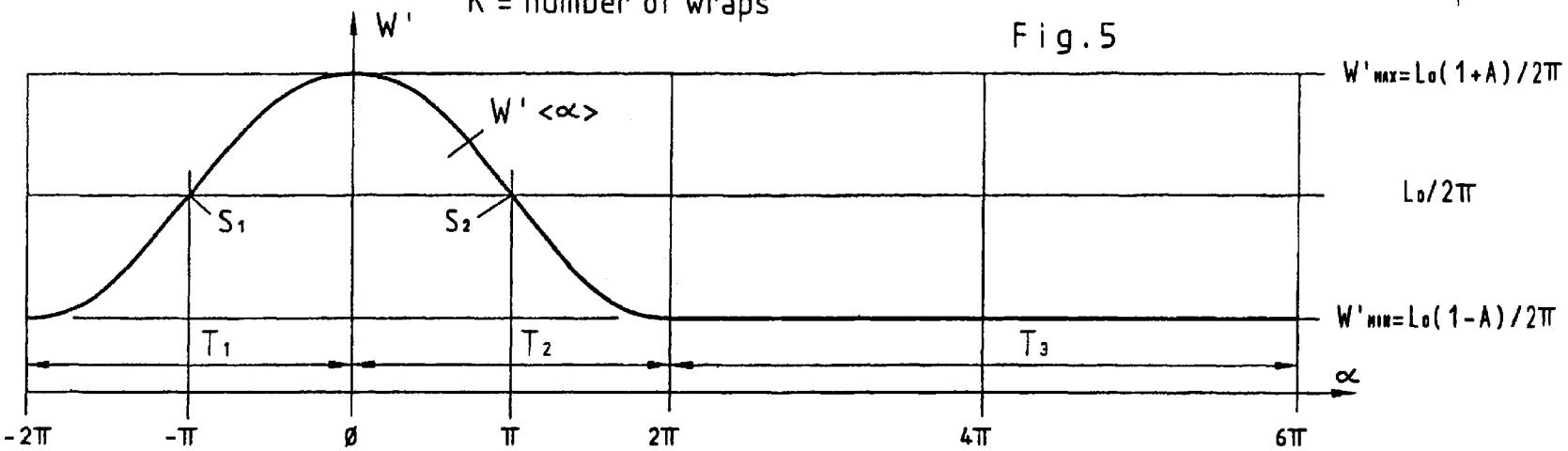
FIG. 5: the changes in the axial position (w') depending upon the wrapping angle ($\alpha$), which progresses proportionally to the dynamic pitch according to $L_{dyn}=2\pi\cdot w'$.
Figure 9:
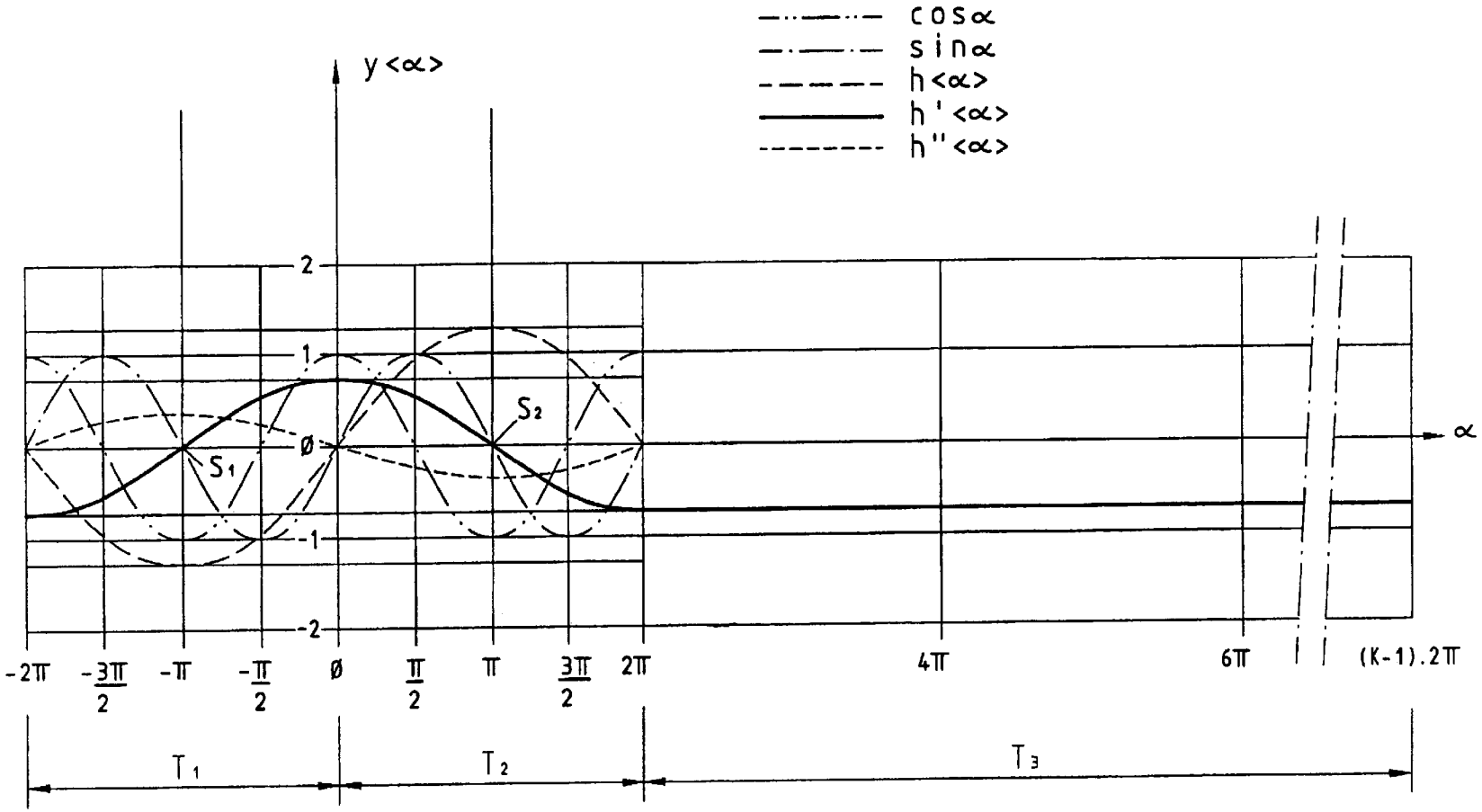
FIG. 9: the symmetrical progression of individual partial functions of the pitch and balancing calculation.

1) $L_1=L_2=L_0$
2) B=A
3) j=1 compare FIGS. 5 and 9

With a mean value of w'<−π>=w'<π>=$L_0/2\pi$ (corresponds to pitch $L_0$) and a variation ±A·100%=>$w'_{max}=L_0(1+A)/2\pi$ $w'_{min}=L_0(1-A)/2\pi$ The calculation according to known, relevant methods thus yields from (1), (2), (3), (4):

$$\frac{P_u}{\tau\omega^2 g_0} = -2 \cdot w\langle 2\pi\rangle + 2\int_{-2\pi}^{+2\pi} w'\langle\alpha\rangle\left(\cos^2\frac{\alpha}{2}\right) d\alpha \quad (1a)$$

$$\frac{P_v}{\tau\omega^2 g_0} = 2\int_{-2\pi}^{+2\pi} w''\langle\alpha\rangle\left(\cos^2\frac{\alpha}{2}\right) d\alpha \quad (2a)$$

$$\frac{M_{v,w}}{\tau\omega^2 g_0} = -(K-2)L_0^2(1-A)^2/2\pi + \int_{-2\pi}^{+2\pi} w\langle\alpha\rangle w'\langle\alpha\rangle \sin\alpha d\alpha \quad (3a)$$

$$\frac{M_{u,w}}{\tau\omega^2 g_0} = \int_{-2\pi}^{+2\pi} w\langle\alpha\rangle w'\langle\alpha\rangle \cos\alpha d\alpha \quad (4a)$$

For simplification of further calculation, the function h=h<α> is inserted, so that.

$$w = \frac{L_0}{2\pi}(\alpha + h)$$

$$w' = \frac{L_0}{2\pi}(1 + h')$$

$$w'' = \frac{L_0}{2\pi}h''$$

See FIG. 9 for the graphic representation.

The symmetry features, expressed mathematically, of a screw rotor according to the invention are:

I. Basic Symmetries:

h<−α>=−h<α>($a_1$) h'<−α>=−h'<α>($a_2$) h"<−α>=−h"<α>($a_3$)

h<2π−α>=h<α>($b_1$) h'<2π−α>=−h'<α>($b_2$) h"<2π−α>=h"<α>($b_3$)

$h_{max}$=h<π>=(depending upon function) h'<0>=A=$h'_{max}$ $h_{min}$=h<−π>=−($h_{max}$) h'<2π>=−A=$h'_{min}$ II. Derived Symmetries:

(−α)(h<−α>)cos<−α>=α(h<α>)cos<α>(e)=>function symmetrical to α=0

(h<−α>)(h'<−α>)sin<−α>=h<α>h'<α>sin<α>(f)=>function symmetrical to α=0

Thus from (1a), (2a), (3a), (4a) it follows:

$$\frac{P_u}{\tau\omega^2 g_0} = \frac{L_0}{2\pi}\int_{-2\pi}^{+2\pi} h'\cos^2\frac{\alpha}{2}d\alpha = 0 \tag{1b}$$

(owing to symmetry to $\alpha=\pi$; $\alpha=-\pi$)

$$\frac{P_v}{\tau\omega^2 g_0} = \frac{L_0}{2\pi}\int_{-2\pi}^{+2\pi} h''\cos^2\frac{\alpha}{2}d\alpha = 0 \tag{2b}$$

(owing to symmetry)

$$\frac{M_{v,w}}{\tau\omega^2 g_0} = -(K-2)L_0^2(1-A)^2/2\pi + \left(\frac{L_0}{2\pi}\right)^2\left(-4\pi - \int_{-2\pi}^{+2\pi} h\cdot\alpha\cdot\cos\alpha d\alpha - \frac{1}{2}\int_{-2\pi}^{+2\pi} h^2\cos\alpha d\alpha\right) \tag{3b}$$

$$\frac{M_{u,w}}{\tau\omega^2 g_0} = \left(\frac{L_0}{2\pi}\right)^2\left(\int_{-2\pi}^{+2\pi} h\cdot\alpha\cdot\sin\alpha d\alpha + \frac{1}{2}\int_{-2\pi}^{+2\pi} h^2\sin\alpha d\alpha\right) = 0 \tag{4b}$$

(owing to symmetry)

The only value which does not disappear alone through the setting of the symmetry features and of the wrapping angle is $M_{v,w}$ which is necessary for 100% balancing. =>

$$-2\pi((K-2)(1-A)^2+2) = \int_{-2\pi}^{+2\pi} h\cdot\alpha\cdot\cos\alpha d\alpha + \frac{1}{2}\int_{-2\pi}^{+2\pi} h^2\cos\alpha d\alpha \quad (*)$$

When the above symmetry features and constraints are kept, the function h=h<α> can be selected as desired. After it has been selected, A can generally be calculated from (*).

Corresponding to the embodiment examples shown in the drawings:

$$h = 2A\cdot\sin\frac{\alpha}{2} \Rightarrow$$

$$(3K-9)A^2-2(3K-2)A+3K=0 \quad (**) \Rightarrow$$

$$A=(3K-2-\sqrt{15K+4})/(3K-9) \text{ for } K\neq 3$$

$$A=3K/(6K-4)=9/14 \text{ for } K=3$$

Different values for A thus result for varying wrap numbers K, with which the compression rate, in turn, varies.

The following table shows some numerical values:

| Wrap number K | 2 | 3 | 4 | 5 | 6 | 7 |
|---|---|---|---|---|---|---|
| Amplitude A | 0.6103 | 0.6429 | 0.6666... | 0.6853 | 0.7005 | 0.7133 |
| Compression rate $V_d$ | 1.0 | 2.552 | 4.0 | 4.2665 | 4.509 | 4.732 |

Figure 15:
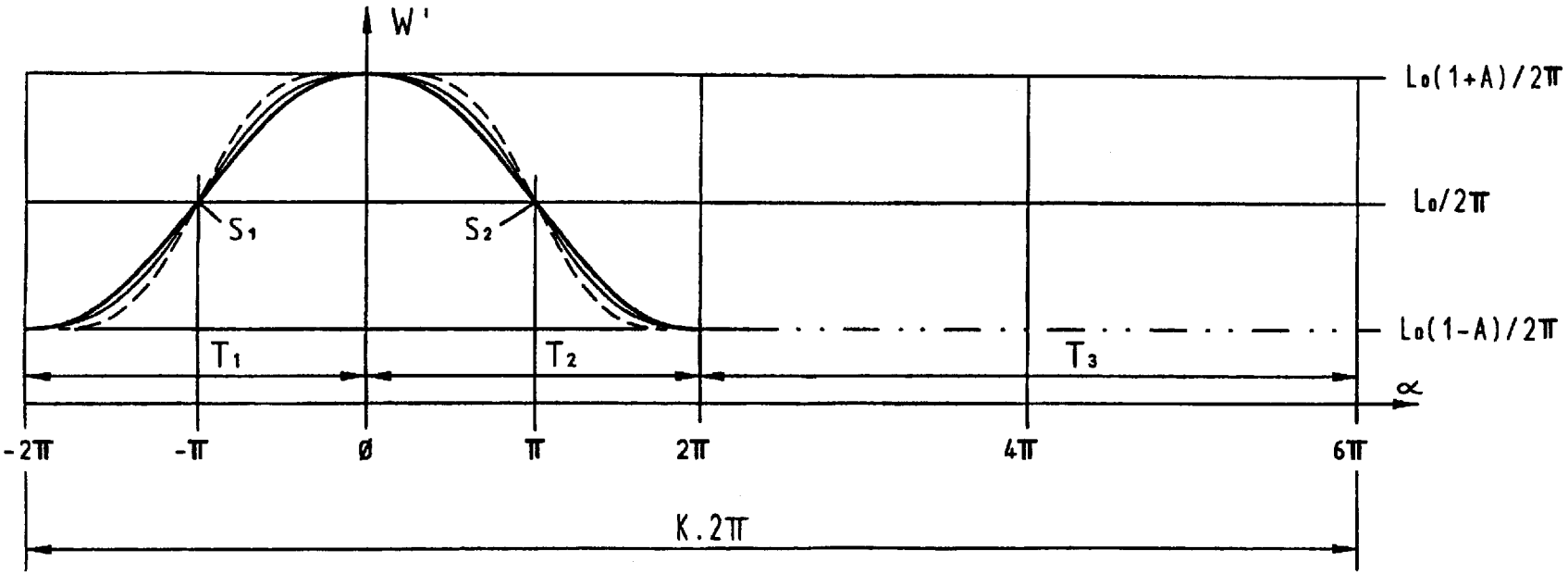
FIG. 15: an additional variation possibility for the pitch course.
Figure 18:
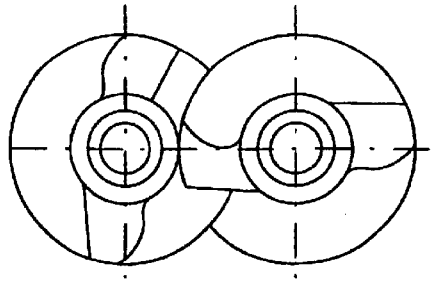
FIG. 18: the screw pair of FIG. 16 in an end view, seen from the suction side.
Figure 19:
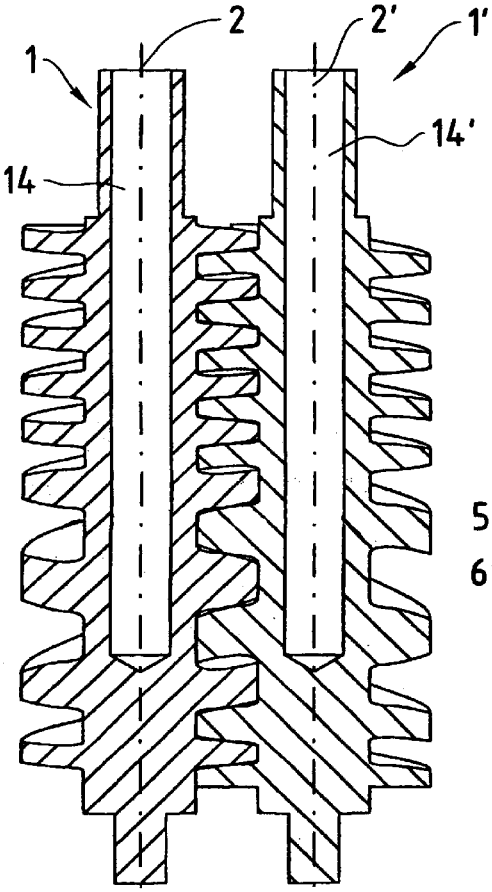
FIG. 19: the screw pair of FIG. 16 in an axial section according to line B—B of FIG. 17
Figure 16:
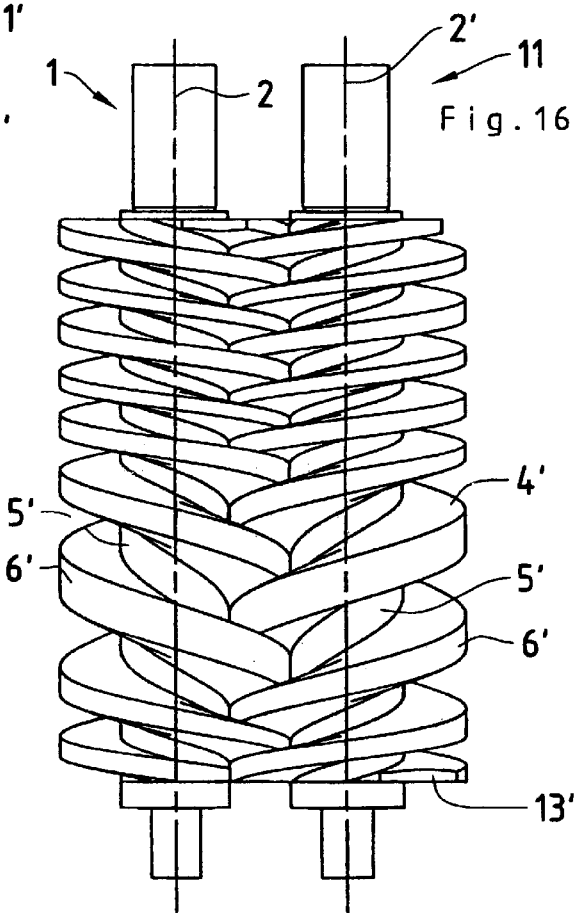
FIG. 16: a set of double-threaded twin screw rotors according to a further embodiment example of the invention in a view from the front.
Figure 17:
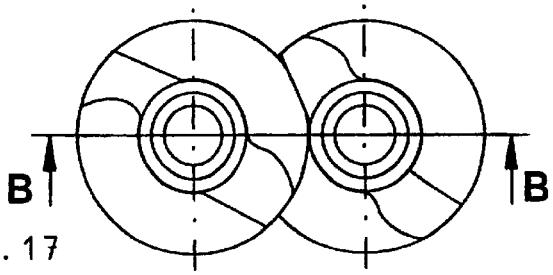
FIG. 17: the screw pair of FIG. 16 in an end view, seen from the pressure side.

For other functions h=h<α>, differing values for A und $V_d$ are obtained. Thus, for example, the function $$h = A\cdot\left(\sin\frac{\alpha}{2}\right)\left(2+D\cdot\left(\left(\sin\frac{\alpha}{2}\right)^2\right)^n\right)$$

permits a variation of the factor D, whereby, with maintenance of the symmetry features as well as the junctions and the minimal/maximal values for the pitch course in detail, and as a consequence, alternatively A or $V_d$ are variable (FIG. 15).

However, for applications requiring large numbers of wrap K but only minimal compression rates $V_d$, the requirement MV, $W_{V,W}/\tau\omega^2=0$ is no longer achievable without further additional measures, even with taking full advantage of the extreme variation of the pitch course. The measures hereby used can be defined in general and in formula terms in a way which is also valid for the above-mentioned shortening corrections of the screw spiral flanks coming to a sharp edge.

Measure 1: Supplementary values through wrapping angle enlargement p on both sides.

Measure 2: Correction by taking off (putting on) material in the two axial positions of the screw ends; two equal values (Q[cm$^4$]); positions of the centers of gravity $SQ_1$, $SQ_2$= angular symmetrical (±(μ+η)) to the U–W–plane.

Valid in general for the four stat. values $$\frac{P_U}{\tau\varpi^2},\ \frac{P_V}{\tau\varpi^2},\ \frac{M_{V,W}}{\tau\varpi^2},\ \frac{M_{U,W}}{\tau\varpi^2}:$$

Factor·{[fundamental value]+[supplementary value]−[correction value]}=0

For the components in detail=>

$$\frac{P_U}{\tau\varpi^2} \Rightarrow \left\{\left[\int_{-2\pi}^{+2\pi} h'\cos^2\frac{\alpha}{2}d\alpha\right] + [(1-A)\sin\mu] - \left[\frac{Q}{g_0\left(\frac{L_0}{2\pi}\right)}\cos(\mu+\eta)\right]\right\} = 0 \tag{1c}$$

$$\frac{P_V}{\tau\varpi^2} \Rightarrow 0+0-0=0 \qquad \text{(trivial)} \tag{2c}$$

$$\frac{M_{V,W}}{\tau\varpi^2} \Rightarrow \left\{\left[-\frac{2\pi((K-2)(1-A)^2+2)+\int_{-2\pi}^{+2\pi} h\cdot\alpha\cdot\cos\alpha d\alpha + \frac{1}{2}\cdot\int_{-2\pi}^{+2\pi} h^2\cos\alpha d\alpha}{2\pi(K-A(K-2))}\right] + \left[\frac{(1-A)(2(1-A)(\sin\mu-\mu\cos\mu)+2\pi(K-(K-2)A)(1-\cos\mu))}{2\pi(K-A(K-2))}\right] - \left[\frac{Q}{g_0\left(\frac{L_0}{2\pi}\right)}\sin(\mu+\eta)\right]\right\} = 0 \tag{3c}$$

-continued $$\frac{M_{U,W}}{\tau\varpi^2} \Rightarrow (K-2)\cdot\left\{[0]+[(1-A)\sin\mu]-\left[\frac{Q}{g_0\left(\frac{L_0}{2\pi}\right)}\cos(\mu+\eta)\right]\right\}=0 \tag{4c}$$

From symmetry of the pitch course in $\alpha=-\pi$, $\alpha=+\pi$ (equations $(b_1)$, $(b_2)$, $(b_3)$)=>(1b), so that the equations (1c) and (4c) become identical. From the system of equations of the two equations (1c) and (3c) (equation (2c) is trivial), one obtains after the separation of variables:

$$Q_{set}=Q<K, A, \mu> \text{and } \eta_{set}=\eta<K, A, \mu>$$

Here $\mu$ is still freely variable.

Since material cannot be removed or put on anywhere desired, there results in particular in the case of the shortening corrections of the screw spiral flanks coming to a sharp edge a dependence $Q=Q<\eta>=\eta=\eta<Q>$, so that the values $\eta$, $\mu$, Q are determined. Imaginary solutions require a subsequent correction of the value A.

Figure 14:
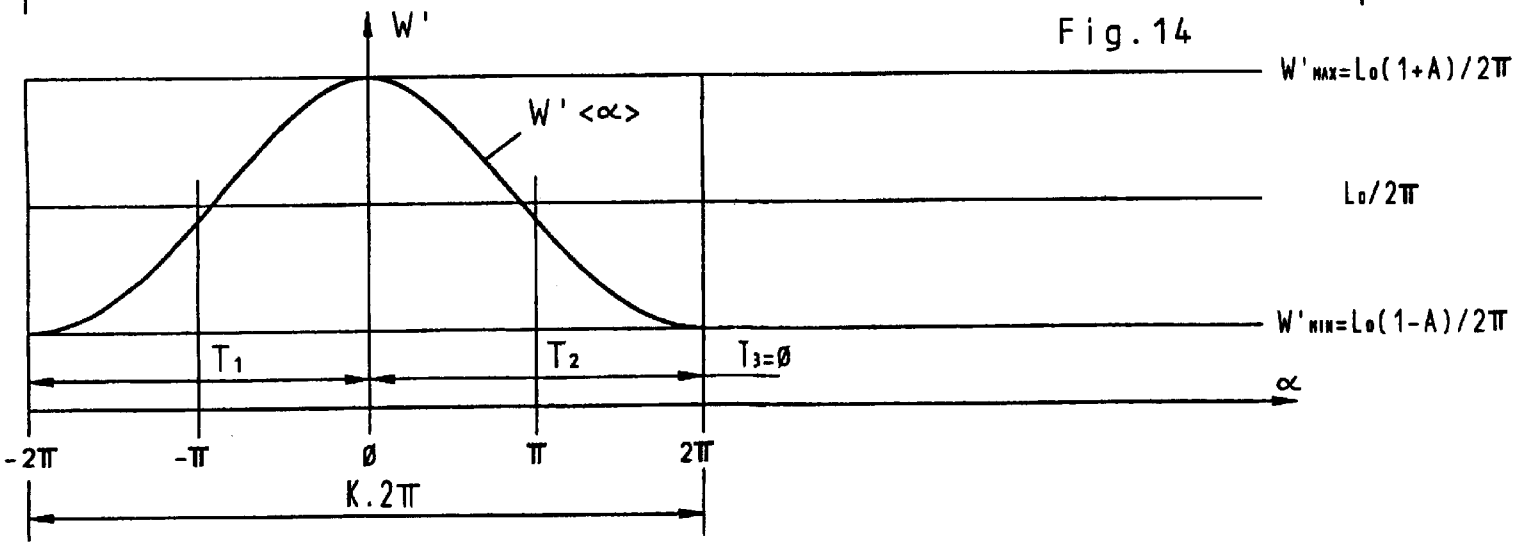
FIG. 14: a possible pitch course of a pair of twin screw rotors according to FIG. 11.

For short screw members (K=2), equation (4c) is fulfilled for all $\eta$, $\mu$, Q. Thus in this case the necessity to achieve (4c)≡(1c) does not apply. Furthermore it follows from this that although (1b) is possible, it is not required in a compulsory way, i.e. the equations $(b_1)$, $(b_2)$, $(b_3)$ (=symmetry in $\alpha=-\pi$; $\alpha=+\pi$) are not compulsory for K=2 (FIG. 14).

With non-constant transverse profiles, the calculation becomes more time-consuming. The geometric reference helix at the concave flank base no longer corresponds to the center-of-gravity helix, which ultimately has consequences right through all the formulas.

FIG. 1 is an illustration of a first embodiment example of the twin screw rotors 1 and 1', the axes 2 and 2' being located in the picture plane. The two rotors 1 and 1' are of cylindrical design, and have thread spirals 3 und 3', which define a constant outer diameter that is limited by the generated surfaces 6 and 6'. The twin rotors are disposed parallel in such a way that the thread spirals engage in one another in a meshing way. The generated surfaces 6 or respectively 6' of the rotors, which describe in rotation two overlapping cylinder surfaces having parallel axes, move adjacent to the housing 9 (shown in FIG. 2). Defined inside the housing 9 between the core cylinder surfaces 5, 5', the flanks 4, 4' and the housing wall 10 is a series of chambers, which moves from one axial end to the other during rotation of the rotors in opposite directions, whereby the chamber volume changes depending upon the rotational angle and the pitch course: in the suction phase, the volume increases to a maximal value, then in the compression phase the volume is decreased, and finally, upon opening of the chamber during the discharge phase, the volume is reduced to zero. The end faces of the rotors are designated by 7 and 7' on the suction side and by 8 and 8' on the discharge side.

Figure 2:
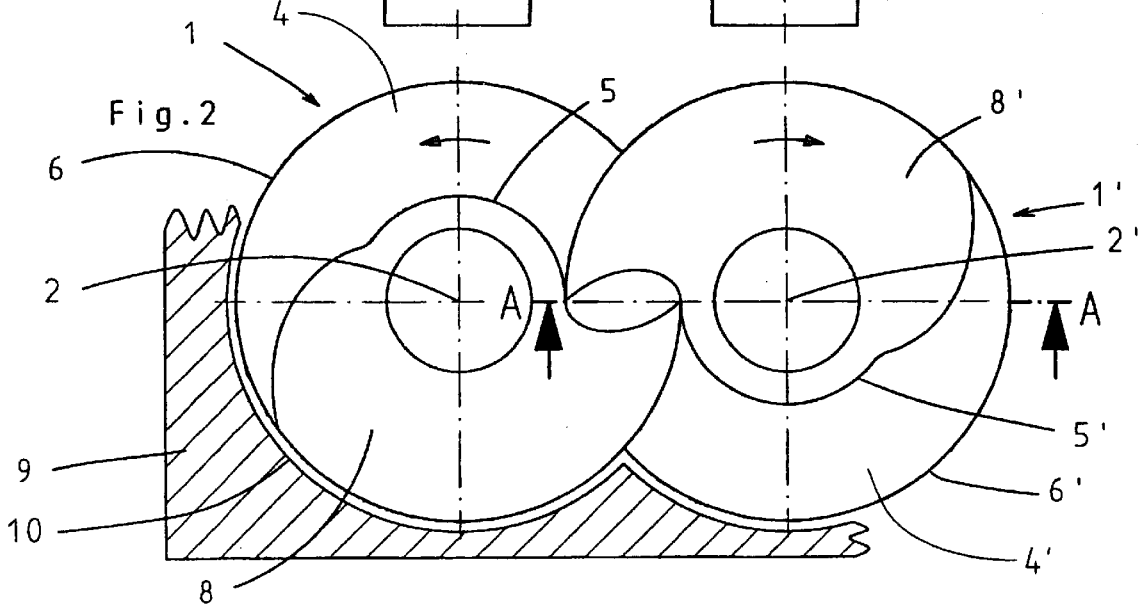
FIG. 2: the set of twin screw rotors of FIG. 1 in an end view.

FIG. 2 is a view of the end faces of the twin rotors on the discharge side (view from above in FIG. 1). The illustration shows a projection of two engaging, axis-parallel rotors. The reference numerals 2 und 2' designate the parallel rotational axes of the rotors 1 and 1'. The flanks are designated by the reference numerals 4 and 4', whereas 8 und 8' designate the adjacent front faces, which delimit the rotors in the longitudinal direction. Designated by 5 and 5' are the core cylinder surfaces of the rotors, which have a constant diameter. In a displacement machine, the rotors are installed in a housing 9 with an inner wall 10. For contact-free operation of such machines, the gaps between the two rotors as well as between the rotors and the inner wall measure about 1/10 mm each. The plane A—A is an intersecting plane, which defines a longitudinal section of the rotor according to FIG. 3.

Figure 3:
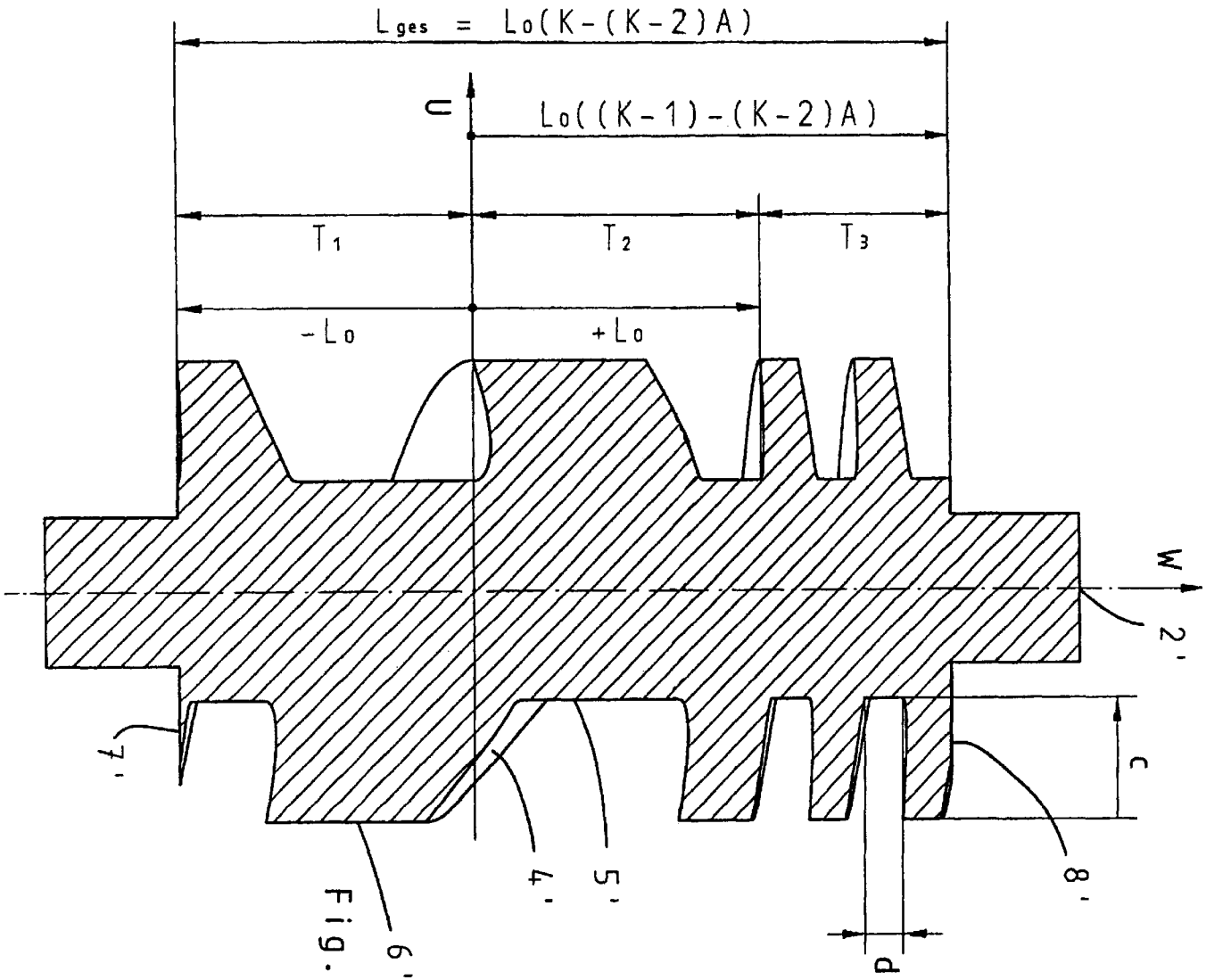
FIG. 3: the right-hand screw rotor in an axial section along the line A—A of FIG. 2.

FIG. 3 is the aforementioned longitudinal section through the rotor along the plane A—A of FIG. 2. The reference numerals correspond to those of FIGS. 1 and 2. However, the rotational axis is designated here by W, whereas in FIGS. 1 and 2 it is designated by 2 and 2'. W and U are part of the system of coordinates U,V,W, used for the calculations. The point zero of the system of coordinates is located at that place on the axis W, where the pitch has a maximal value (reversal point in the diagram w<α>). The thread depth c is constant, whereas the thread height d, depending upon the pitch of the spiral, is variable.

Figure 4:
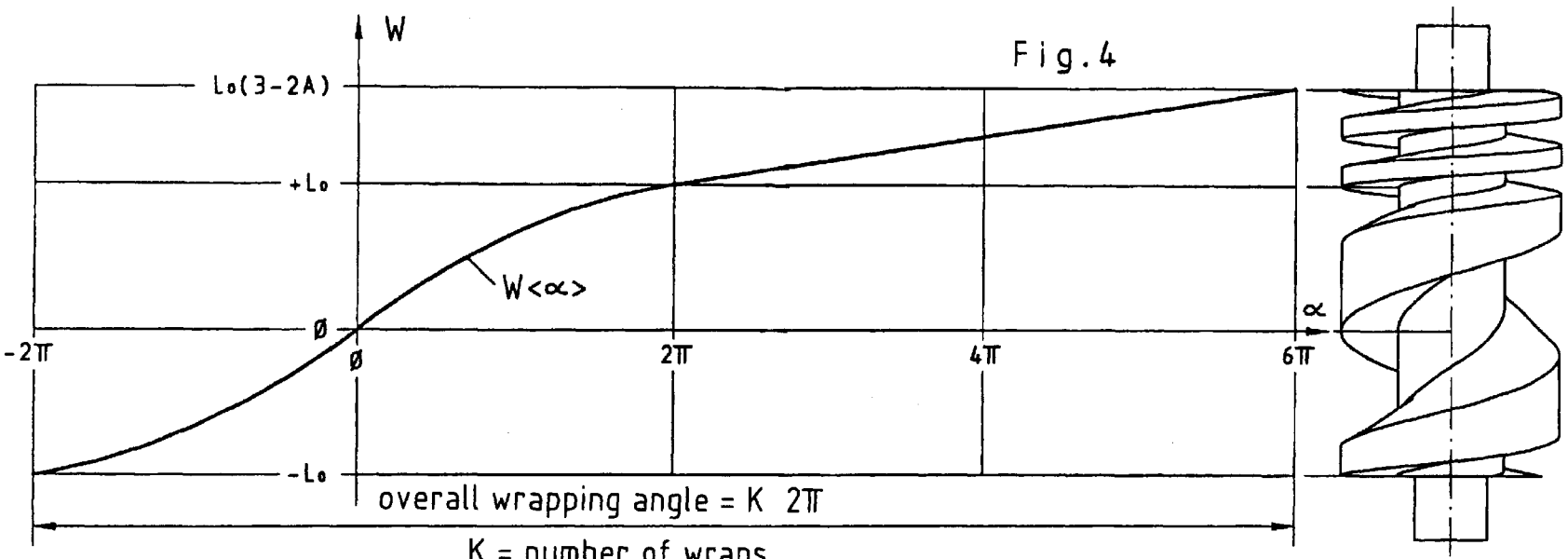
FIG. 4: the right-hand screw rotor of FIG. 1 in a view from the front as well as is the associated development of the transverse profile center-of-gravity locus curve, showing the dependence of the axial position (w) upon the wrapping angle ($\alpha$)

FIG. 4 shows the right-hand screw rotor in a view from the front, corresponding to the rotor positioned on the right in FIG. 1, as well as the associated developed view of the transverse profile center-of-gravity locus curve, which shows the dependence of the axial position (w) upon the wrapping angle ($\alpha$). Since, regardless of the pitch of the spiral, the profile of the screw rotor is constant, the cross-sections over the entire length of the rotor differ from one another only in relation to the angular position $\alpha$ with respect to the U-axis. Furthermore the center of gravity of the cross-sections is not identical to the axis position W, but instead is positioned at a constant spacing $r_0$. Therefore a spiral line (cf. FIG. 6) with a pitch corresponding to that of the wrap of the rotor is described by the common location of all centers of gravity of the cross-sections. It can be seen from the diagram, with their development, that the pitch of the spirals during the first wrap increases continuously from position $-2\pi$, until the reversal point, at position 0, after which the pitch continuously decreases until the end of the second wrap until position $2\pi$, and finally remains constant until position $6\pi$.

FIG. 5 shows a curve illustrating the changes in the axial position (w') depending upon the wrapping angle ($\alpha$), which runs proportionally to the dynamic pitch according to $L_{dyn}=2\pi\cdot w'$. Visible here is the mirror symmetry of the curve to $\alpha=0$ as well as the symmetry of points $S_1$ to $\alpha=-\pi$ and $S_2$ to $\alpha=+\pi$ in the range $-2\pi$ to $+2\pi$ of the subdivisions of the curve on the left-hand side and on the right-hand side of the line at $\alpha=0$, respectively. These features are essential for overcoming the balance error of the rotors, and represent the gist of the invention.

Figure 6:
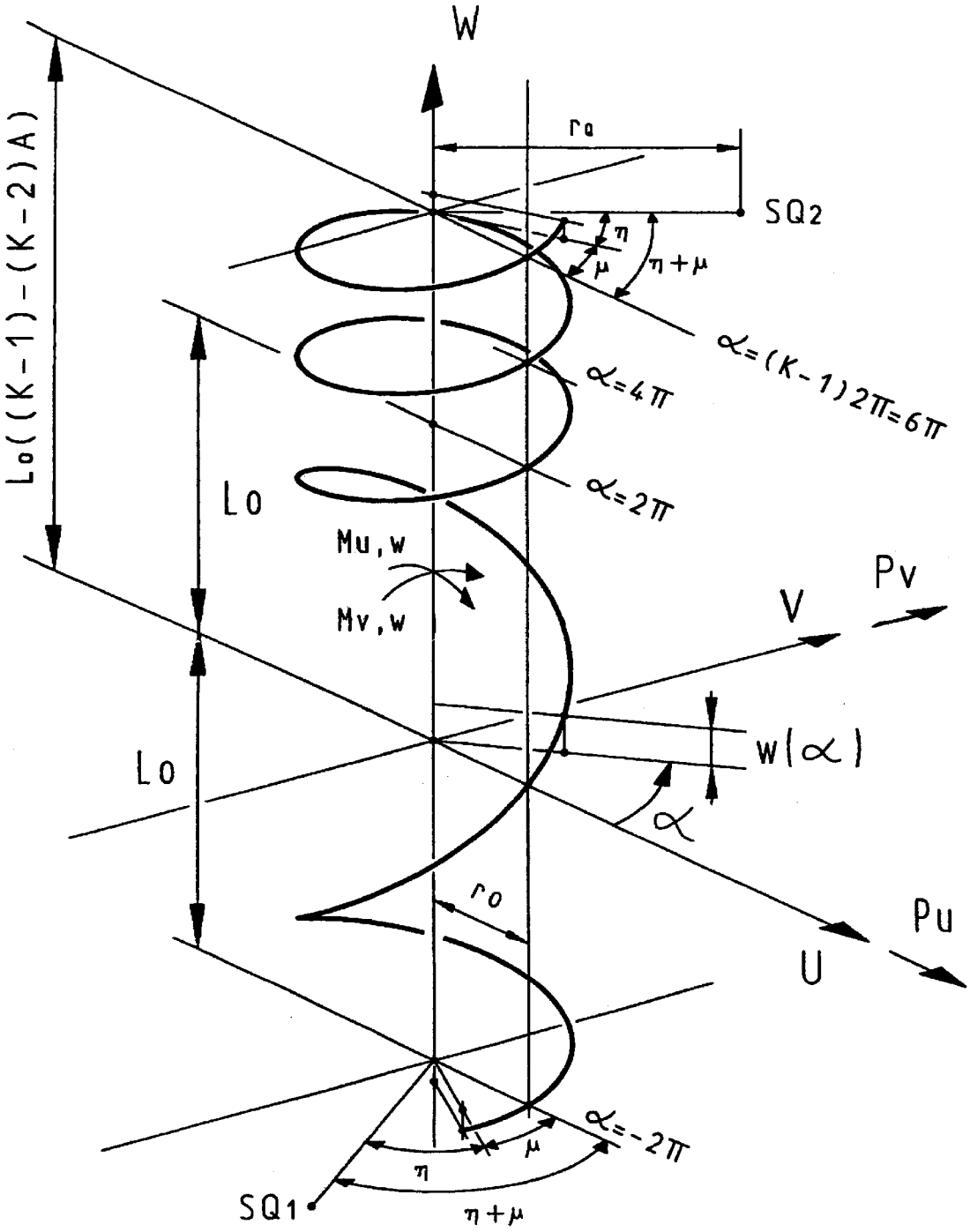
FIG. 6: in a perspective view, the helical transverse profile center-of-gravity locus curve of a right-hand screw rotor according to the invention with a wrap number of K=4.

FIG. 6 shows the helical transverse profile center-of-gravity locus curve of a right-hand screw rotor according to the invention with a wrap number of K=4 in a perspective view corresponding to the development according to FIG. 4. The symbols indicated correspond to the definitions given earlier for the calculations. The wrapping angle enlargement $\mu$ and the relative position angle $\eta$ of the balancing volume $g_Q$ have been additionally drawn in above and below.

Figure 7:
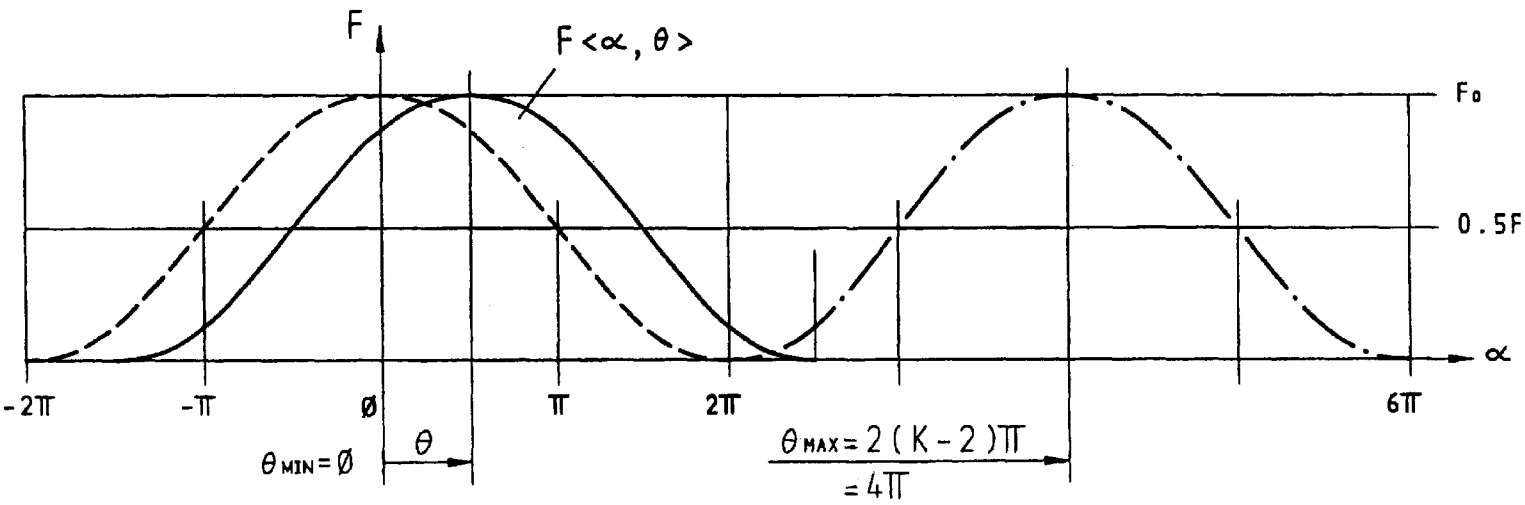
FIG. 7: the cross-sectional values of a closed chamber depending upon the angle ($\alpha_0$) of the geometric reference helix as well as the angle of rotation ($\theta$)

FIG. 7 is a diagram showing the cross-sectional values (surface F) of a closed chamber depending upon the angle ($\alpha_0$) of the geometric reference helix as well as the rotational angle ($\theta$).

Figure 8:
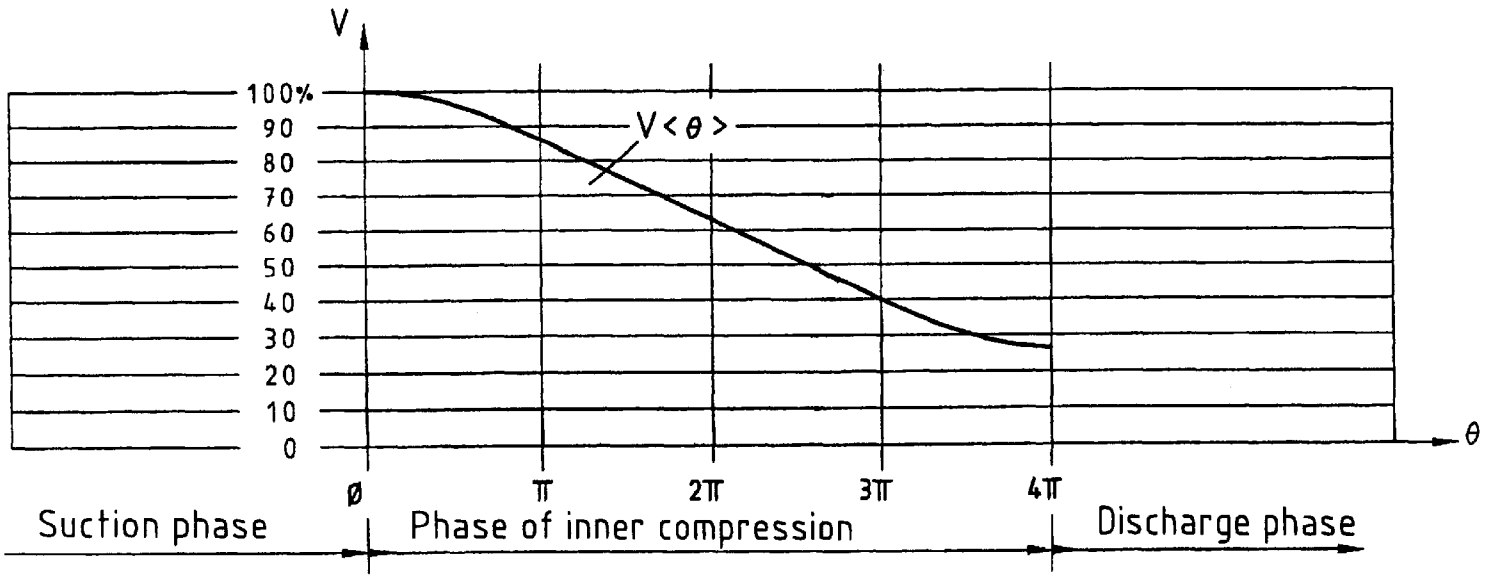
FIG. 8: the progression of compression depending upon the angle of rotation ($\theta$)

FIG. 8 is a diagram showing the course of compression (% of the initial volume) in a closed chamber depending upon the rotational angle ($\theta$).

FIG. 9 shows the symmetrical progression of individual partial functions of the pitch and balancing calculation (cosα, sinα, h<α>, h'<α>, h"<α>). With respect to the significance of the symbols, reference is to be made to the calculations and the corresponding definitions in this specification.

Figure 11:
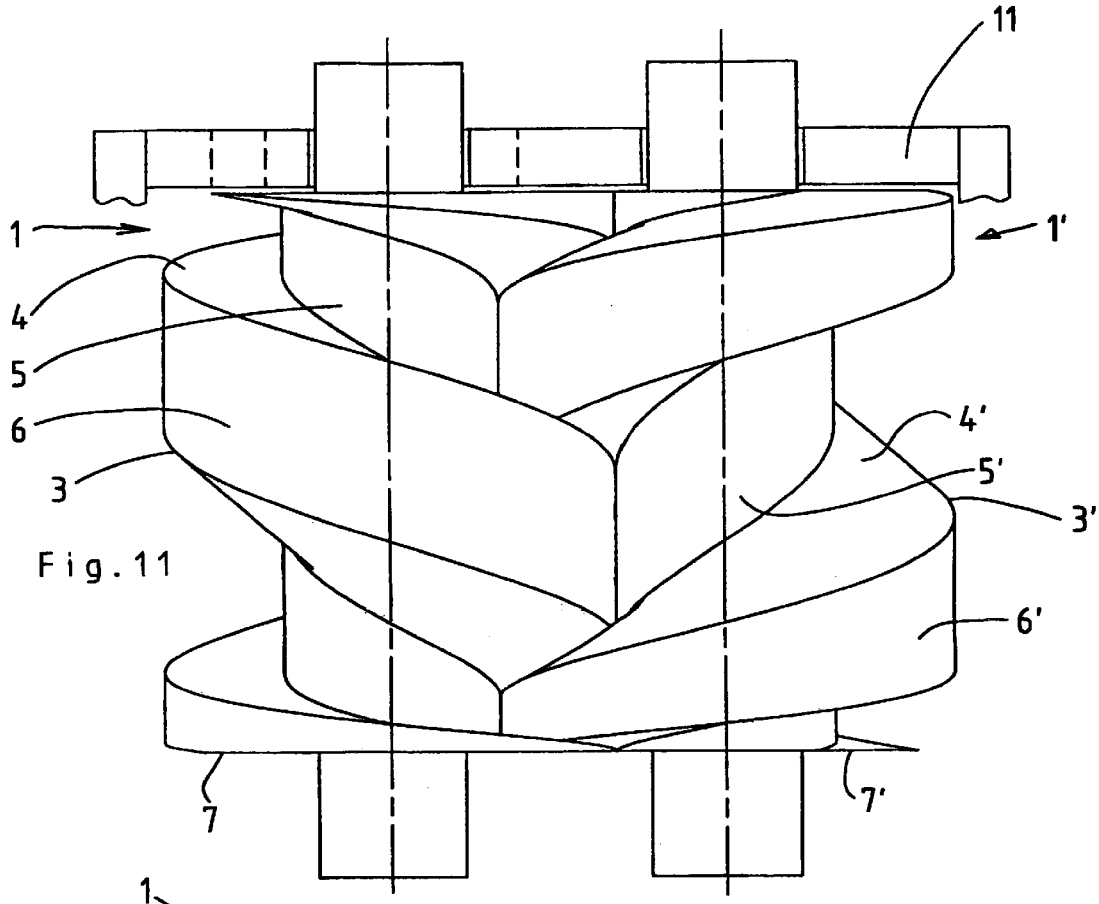
FIG. 11: a set of twin screw rotors according to a further embodiment example of the invention in a view from the front.
Figure 12:
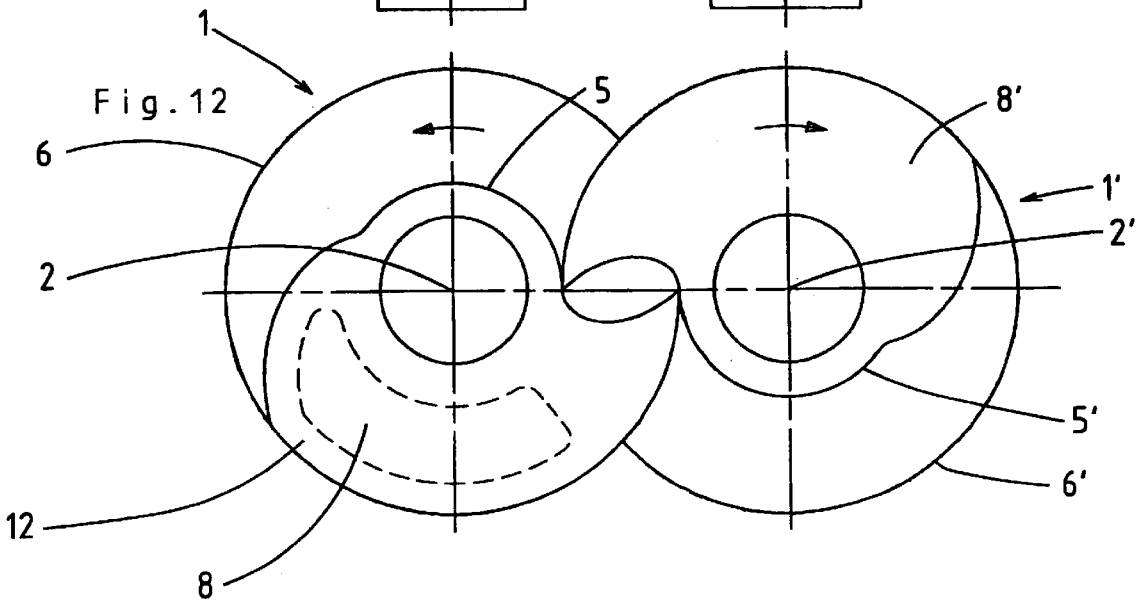
FIG. 12: the set of twin screw rotors of FIG. 11 in an end view.

FIGS. 11 and 12 show a further embodiment example in the form of a pair of short screw members with a wrap number K=2 (as well as a reduction of the subdivision $T_3$ to "zero"). The same reference numerals as in FIGS. 1 and 2 are used for the same parts. With these screw members, the point in time of the closing toward the suction side and of the opening to the pressure side for the central, completely formed chamber coincides, so that a displacement machine thus equipped operates isochorically. The point in time of the opening to the pressure side can be delayed through an end-side end plate 11 with an exit aperture 12, which is closed and released by the rotor 1, as is known in the state of the art. Thus an inner compression can be achieved with this embodiment example too.

In a sub-variant of the second embodiment example, the short screw members (FIGS. 11, 12) are designed according to a pitch course of FIG. 14, which likewise runs symmetrically with respect to α=0 in the regions $T_1$ and $T_2$, but deviates from the course explained in connection with FIG. 5, however, in that the said point symmetries are not present here.

FIGS. 16 to 19 show, as a further embodiment example of the invention, a rotor set with double-threaded, asymmetrical transverse profiles with eccentric center of gravity position and a number of wraps K=4. Extension of the wrapping angle on both sides $$(\mu = \frac{\pi}{2}).$$

The profile is corrected on each end face at two screw spiral flanks each, coming to a sharp edge, in that material has been taken away there. The reference numeral 13' in FIG. 16 designates a surface treated in this way. The large rotor surface, here achieved through multiple threads and large number of wraps, and coaxial cylinder bores (14, 14') in the rotors (1, 1'), through which a cooling agent flows, create the prerequisites here for special uses in displacement pumps for chemistry in which low gas temperatures are required. The pitch course is similar to that of the first of the embodiment examples described, it deviating here, owing to the application, A=0.4 with $V_d$=2.0. The values Q and η in the formulas (1c), (3c) and (4c) are combined because material has been removed at each end at two places 13' in the case of the double-threaded screw members.

Figure 10:
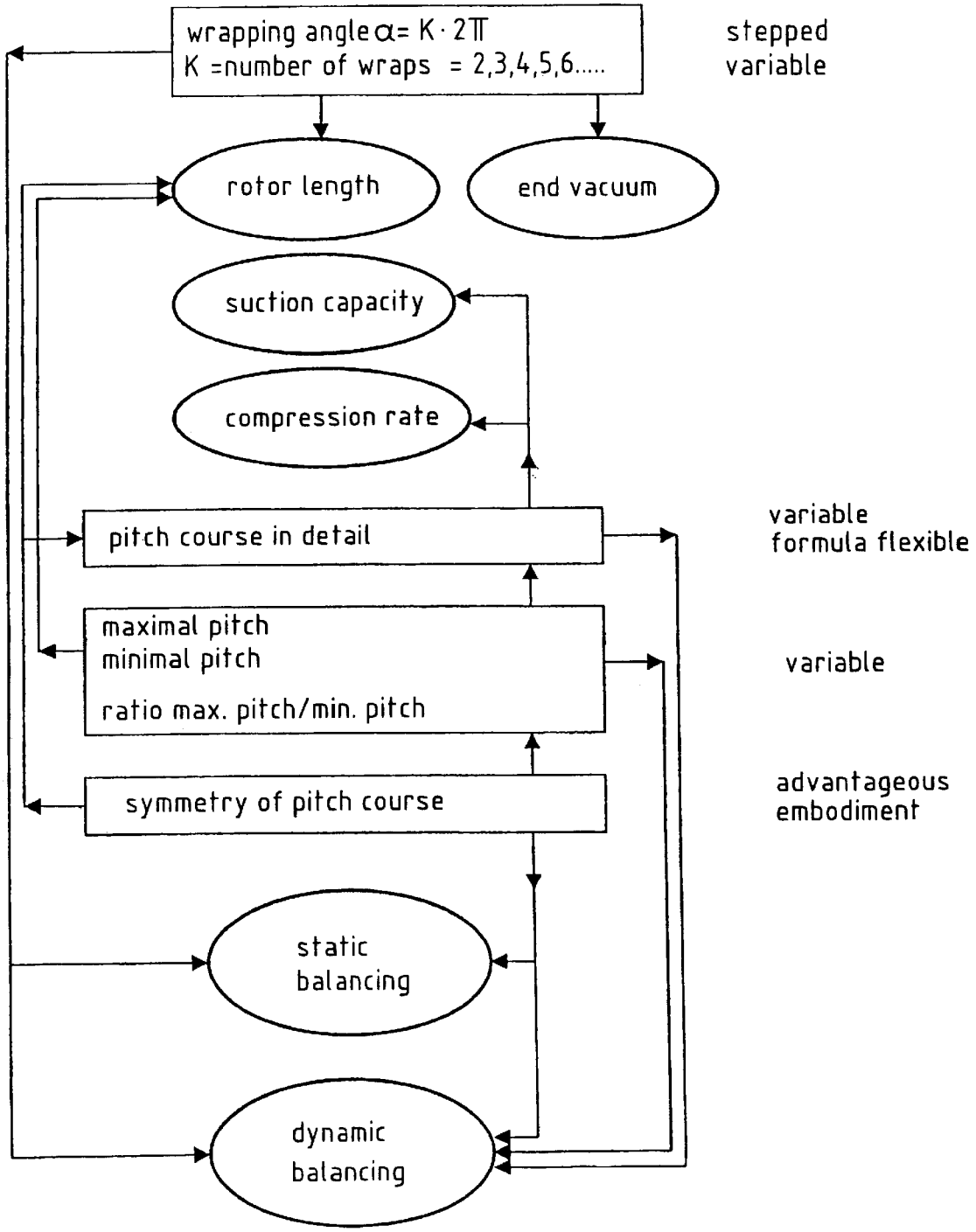
FIG. 10: a block diagram showing ranges of influence and interrelationships in the rotor dimensioning.

FIG. 10 is a block diagram showing data on influence and interrelationships which are of significance for the rotor dimensioning.

What is claimed is:

1. Twin screw rotors for axis-parallel installation in displacement machines for compressible media, with asymmetrical transverse profiles with eccentric center of gravity position as well as numbers of wraps ≧2 and with pitch (L) varying depending upon the wrapping angle (α), which increases from the suction-side screw end in a first subdivision ($T_1$), reaches a maximal value ($L_{max}$) at α=0 after one wrap, decreases to a minimal value ($L_{min}$) in a second subdivision ($T_2$), and is constant in a third subdivision ($T_3$), wherein static and dynamic balancing is achieved through calculated balancing of overall wrapping angle, defined pitch course and ratio of maximal pitch to minimal pitch, or is achieved at least 80% and is supplemented by changes in the geometry in the region of the screw ends.

2. Twin screw rotors according to claim 1, wherein the relation of maximal pitch to minimal pitch and the pitch course are fixed in such a way that the compression rates of the displacement machine for compressible media, in which the twin rotors are installed, takes on a desired value in the range of 1.0 to 10.0.

3. Twin screw rotors according to claim 1, wherein the maximal pitch, the minimal pitch and the pitch course are fixed in such a way that the suction capability of the displacement machine for compressible media, in which the twin rotors are installed, corresponds to the desired value.

4. Twin screw rotors according to claim 1, wherein the rotor length is established by using the number of wraps as well as by using the maximal and minimal pitch.

5. Twin screw rotors according to claim 1, wherein the change in pitch at the subdivisional transitions is zero, when the wrapping angle α is −360°, 0°, or +360°

6. Twin screw rotors according to claim 1, wherein the courses of pitch in the first two subdivisions ($T_1$, $T_2$) are designed mirror-inverted to each other, and wherein the wrapping angle of the third subdivision ($T_3$) equals "zero," the static and dynamic balancing being achieved through the above-defined symmetry features of the pitch course, the setting of the ratio of maximal pitch to minimal pitch, of the defined pitch course as well as through changes in the geometry in the region of the screw ends.

7. Twin screw rotors according to claim 1, wherein the courses of pitch in the first two subdivisions ($T_1$, $T_2$) are designed mirror-inverted to each other, and wherein the course in each of the subdivisions ($T_1$, $T_2$) in one point of symmetry each, namely $S_1$ at α=−180° and $S_2$ at α=+180°, passes through the arithmetic mean value ($L_0$) from the maximal pitch and the minimal pitch in a point-symmetrical way, and wherein the third subdivision ($T_3$) extends over a wrapping angle of whole-number multiples of 360°, the static balancing being achieved through the above-defined symmetry features of the pitch course and the setting of the overall wrapping angle, and the dynamic balancing being achieved through the above-mentioned symmetry features of the pitch course and through the setting of the overall wrapping angle as well as setting of the ratio of maximal pitch to minimal pitch and of the defined pitch course.

8. Twin screw rotors according to claim 1, wherein the courses of pitch in the first two subdivisions ($T_1$, $T_2$) are designed mirror-inverted to each other, and wherein the course in each of the subdivisions ($T_1$, $T_2$) in one point of symmetry each, namely $S_1$ at α=−180° and $S_2$ at α=+180°, passes through the arithmetic mean value ($L_0$) from the maximal pitch and the minimal pitch in a point-symmetrical way, and wherein the third subdivision ($T_3$) extends over a wrapping angle of whole-number multiples of 360°, the static balancing being achieved through the above-defined symmetry features of the pitch course and the setting of the overall wrapping angle and through changes in the geometry in the region of the screw ends, and the dynamic balancing being achieved through the above-mentioned symmetry features of the pitch course and through the setting of the overall wrapping angle as well of the ratio of maximal pitch to minimal pitch and of the defined pitch course and through changes in the geometry in the region of the screw ends.

9. Twin screw rotors according to claim 1, wherein the transverse profile is constant.

10. Twin screw rotors according to claim 1, wherein the transverse profile is variable as a function of the wrapping angle (α).

11. Twin screw rotors according to claim 1, wherein the transverse profile is single-threaded.

12. Twin screw rotors according to claim 1, wherein the transverse profile is multi-threaded.

13. Displacement machine for compressible media comprising a housing, an inlet and an outlet for the admission or respectively discharge of the compressible medium, a pair of twin screw rotors in meshing engagement, substantially free of imbalance, which rotors define with the housing an axial sequence of chambers, the rotors being borne rotatably in the housing and being provided with a drive as well as a synchronization device in order to turn the rotors in opposite directions in such a way that the medium is transported from the inlet to the outlet, wherein twin screw rotors, substantially free of imbalance, are installed according to claim 1.

14. Displacement machine according to claim 13, wherein it is designed as a vacuum pump.

* * * * *

UNITED STATES PATENT AND TRADEMARK OFFICE

CERTIFICATE OF CORRECTION

PATENT NO. : 6,702,558 B2
DATED : March 9, 2004
INVENTOR(S) : Ulrich Becher

It is certified that error appears in the above-identified patent and that said Letters Patent is hereby corrected as shown below:

Column 5,
Line 18, should read -- $\dot{\theta} = \frac{\partial\theta}{\partial t} = \omega = 2\pi/T$ = rotor rotational speed [Rad/sec] --

Column 6,
Line 52, expression ($a_2$) should read -- $h'\langle -\alpha\rangle = h'\langle\alpha\rangle\,(a_2)$ --

Column 7,
Lines 3-5, Equation (1b) should read

-- $$\frac{P_u}{\tau\omega^2 g_0} = \frac{L_0}{\pi}\int_{-2\pi}^{+2\pi} h'\cos^2\frac{\alpha}{2}\,d\alpha = 0 \text{ (owing to symmetry to } \alpha = \pi;\ \alpha = -\pi) \qquad (1b)$$ --

Equation (2b) should read

-- $$\frac{P_v}{\tau\omega^2 g_0} = \frac{L_0}{\pi}\int_{-2\pi}^{+2\pi} h''\cos^2\frac{\alpha}{2}\,d\alpha = 0 \text{ (owing to symmetry)} \qquad (2b)$$ --

Column 8,
Line 25, should read -- $h'\langle -\alpha\rangle = h'\langle\alpha\rangle\,(a_2)$ --

Line 33, should read -- angle enlargement $\mu$ --

Column 9,
Line 19, should read -- $Q = Q\langle\eta\rangle \leftrightharpoons \eta = \eta\langle Q\rangle$ --

Signed and Sealed this

Twenty-ninth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,702,558 B2
DATED : March 9, 2004
INVENTOR(S) : Ulrich Becher

It is certified that error appears in the above-identified patent and that said Letters Patent is hereby corrected as shown below:

Column 8,
Line 25, should read -- $M_{v,\ w}/\tau\omega^2 = 0$ --

Signed and Sealed this

Twenty-fourth Day of August, 2004

JON W. DUDAS
*Director of the United States Patent and Trademark Office*